United States Patent [19]

Jonelis et al.

[11] Patent Number: 4,932,985

[45] Date of Patent: Jun. 12, 1990

[54] RAPPER CONSTRUCTION

[75] Inventors: Robert E. Jonelis, Barrington; John A. Jonelis, Crystal Lake; David L. Parta, Naperville, all of Ill.; Glen M. Peterson, Brainerd, Minn.

[73] Assignee: Midwest Power Corp., Rolling Meadows, Ill.

[21] Appl. No.: 348,220

[22] Filed: May 5, 1989

[51] Int. Cl.[5] ..... B03C 3/76

[52] U.S. Cl. ..... 55/112; 55/300; 173/89; 173/123; 173/131

[58] Field of Search ..... 173/89, 131, 123, 124; 55/112, 300

[56] References Cited

U.S. PATENT DOCUMENTS

| | | | |
|---|---|---|---|
| 442,021 | 12/1890 | Davenport et al. | 173/89 |
| 589,614 | 9/1897 | Polson | 173/89 X |
| 3,823,786 | 7/1974 | Voitsekhovsky et al. | 173/126 |
| 4,221,573 | 9/1980 | Hankins | 55/112 |
| 4,421,180 | 12/1983 | Fleishman et al. | 173/123 X |

OTHER PUBLICATIONS

Lucidyne Catalog Dated Jan. 1985, entitled, "Drop--Rod Rappers For Discharge Electrodes of Weighted Wire PPTR's", 39 pages.

Lucidyne, Inc., Catalog dated Mar. 1985, entitled, "Envirotech-Buell Precipitator Drop-Rod Rapper Installation Conversion to Drop-Rod Rappers", 18 pgs.

Lucidyne, Inc., Catalog dated Apr. 1985, entitled, "Universal Oil Products (U.O.P.) Precipitator Conversion to Drop-Rod Rappers", 18 pages.

*Primary Examiner*—Frank T. Yost
*Assistant Examiner*—Rinaldi Rada
*Attorney, Agent, or Firm*—Anthony S. Zummer

[57] ABSTRACT

A rapper for use in vibrating parts of an electrostatic precipitator by utilizing an impact force. An anvil is connected to a part of an electrostatic precipitator, such as, a section of electrodes either discharge electrodes or collecting plates or electrodes. A striker is engageable with an impact force on the anvil for vibrating the anvil as a result of the striker applying an impact force to the anvil. The vibration of the anvil is transmitted to the part. An elongated connector has one end connected to the striker. Crank means is connected to the elongated connector for raising the striker above the anvil and allowing the striker to drop into impact engagement with the anvil vibrating the anvil and the part of the electrostatic precipitator.

13 Claims, 6 Drawing Sheets

138
140
142
110
168
100
158
146
156
166
164
112
148
170
172
136
134
108
176
106
132
130
11
128
126
118
124
104
122
11
120
116
114
102

130
128
118
126

RAPPER CONSTRUCTION

BACKGROUND OF THE INVENTION

Electrostatic precipitators have a wide range of uses. Electrostatic precipitators are often used in many applications including power generating stations to collect products of combustion from a boiler before the products of combustion are exhausted to the surrounding atmosphere. Typically, electrostatic precipitators include a plurality of collector plates or curtains. The products of combustion passing the plates will deposit solids on the plates. In addition, the electrostatic precipitators have wires or discharge electrodes positioned between the plates. The discharge electrodes are electrically charged so that products of combustion passing the discharge electrodes become charged with one charge and are attracted to the collector plates. In the course of operation, it is common for material to collect on both active elements, that is, the discharge electrodes and the collector plates. A customary method of removing material from the active elements is to vibrate those elements so that material adhering to the elements is dislodged and falls to the bottom of the electrostatic precipitator where it is collected. A widely accepted method of vibrating the elements is to apply an impact force to the element to generate vibration in the element. The apparatus for applying the impact force is generally known as a rapper or a vibrator.

Typically, rappers are connected to an element of the precipitator through metal supports. In the event that an element of the precipitator is at a high voltage, at least a portion of the rapper is at the same voltage as the element to which the rapper is connected. This requires that the active portion of a rapper in electrical contact with a high voltage element of the precipitator be electrically insulated from another portion of the rapper which drives the active portion.

In many instances, it is necessary to adjust the active portion of the rapper in order to adjust the amount of impact force which is applied to the selected portion of a precipitator. It is desirable to be able to make an adjustment of the impact force without interrupting the electricity which is applied to the high voltage element of the precipitator.

SUMMARY OF THE INVENTION

The present invention relates to an improved rapper for vibrating a part of an electrostatic precipitator, such as, a section of electrodes, either discharge electrodes or collector plates or electrodes. The vibration is generated by an impact force applied to an anvil which is mechanically connected to a part of the electrostatic precipitator. A striker applies an impact force to the anvil for vibrating the anvil and thereby the part of the electrostatic precipitator. An elongated connector has one end connected to the striker. Crank means is connected to the other end of the striker and raises the striker above the anvil and allows the striker to drop into impact engagement with the anvil to vibrate the anvil and the part to which the anvil is connected.

DESCRIPTION OF THE PREFERRED EMBODIMENT

Figure 1:
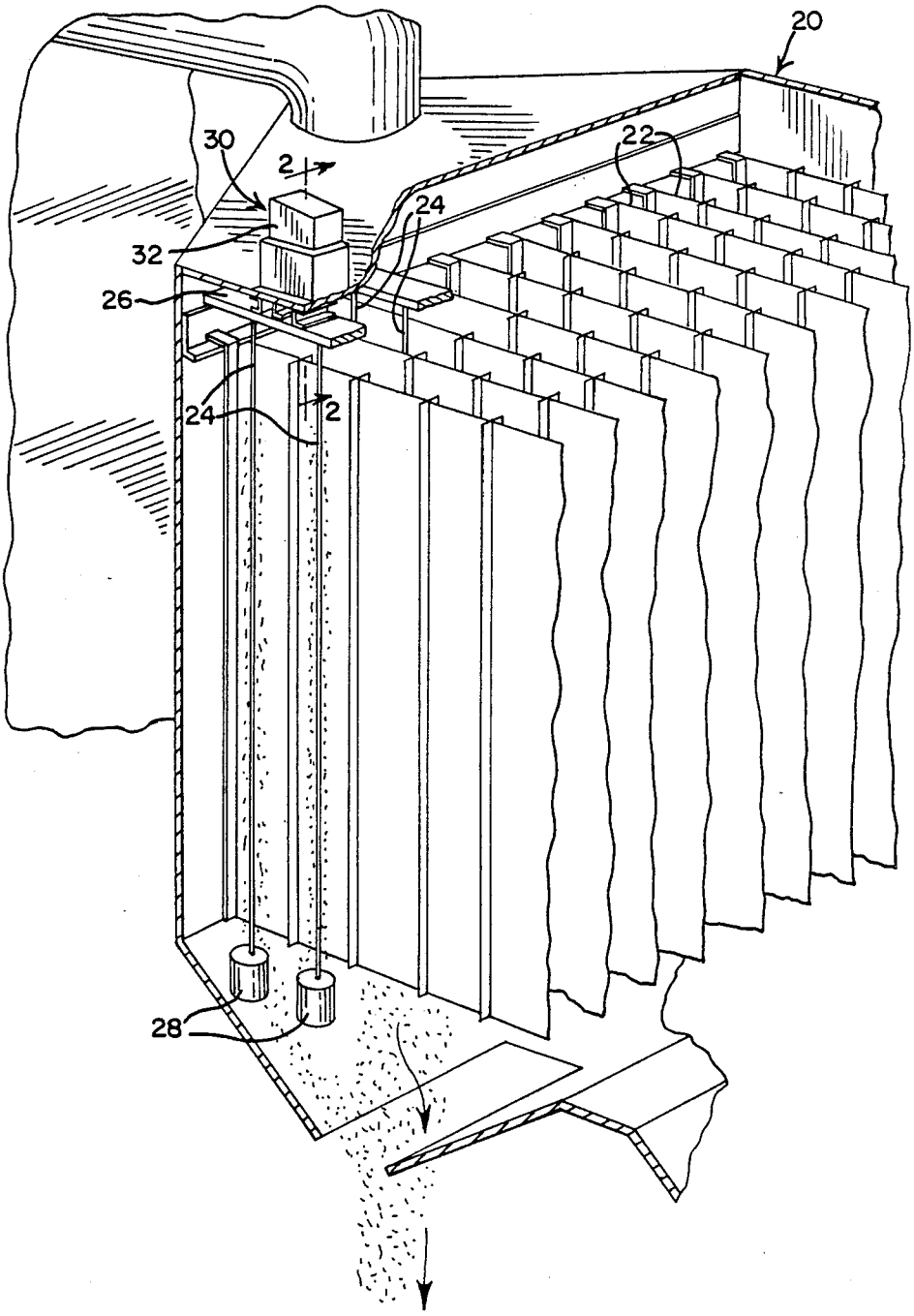
FIG. 1 is a fragmentary view of a portion of a conventional electrostatic precipitator having a plurality of collector plates and a plurality of wires adjacent to the collector plates with a rapper embodying the herein disclosed invention connected to a selected section of wires.

Referring now to the drawings and especially to FIG. 1, a conventional electrostatic precipitator generally indicated by numeral 20 is shown therein. Precipitator 20 includes a plurality of conventional plates or curtains 22 with a plurality of conventional wires or electrodes 24 positioned between the plates. The wires as is conventional are supported by a wire support 26. Each of the wires has a weight 28 fixed to the bottom of each wire to keep each wire taut as is conventional. A rapper 30 embodying the herein disclosed invention is connected to the precipitator and is connected to support 26.

Figure 2:
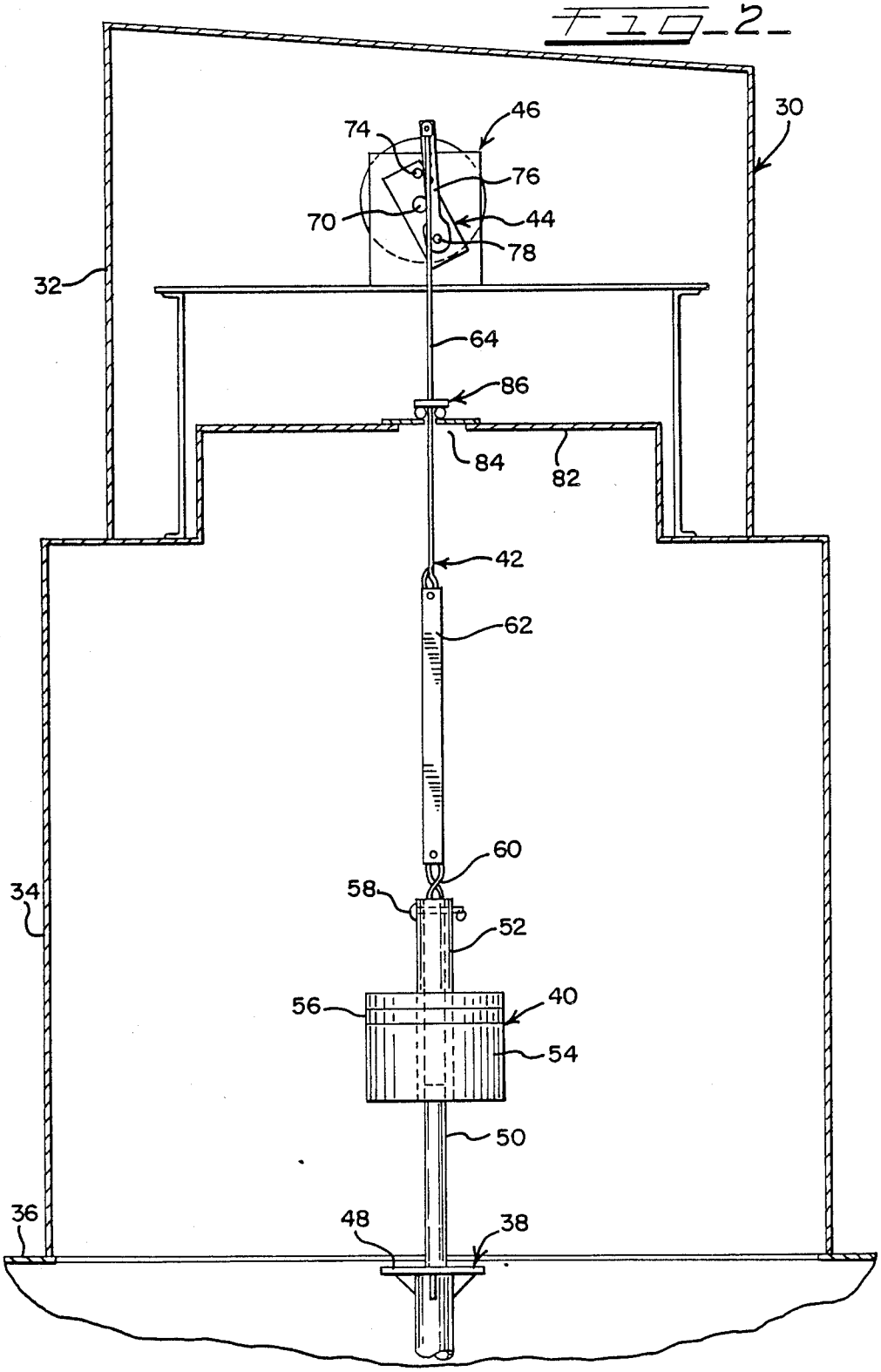
FIG. 2 is an enlarged cross sectional view of the rapper of FIG. 1 which view is taken on line 2—2 of FIG. 1.
Figure 3:
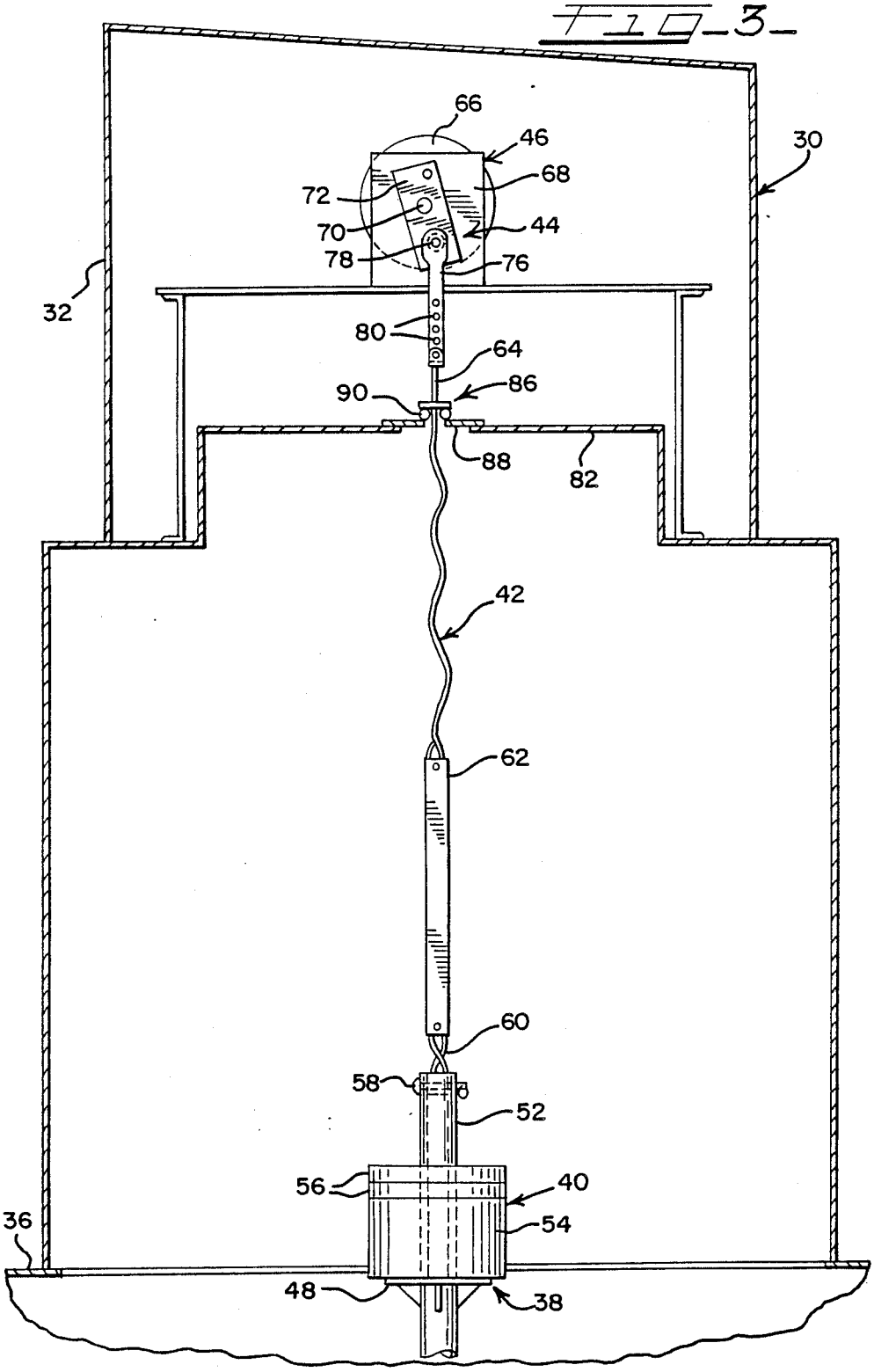
FIG. 3 is an enlarged cross sectional view similar to FIG. 2 but showing the rapper mechanism in the fully down position with a striker in engagement with an anvil.

Referring now to FIG. 2, it may be seen that rapper 30 generally includes a housing 32 mounted on a conventional and well known enclosure 34 which is mounted on a conventional roof 36 of precipitator 20. The rapper includes an anvil assembly 38 which is connected to support 26 as is conventional in the art. A striker assembly 40 is engageable with anvil assembly 38 and is supported by a connector 42 which is in turn connected to a crank assembly or crank means 44 which raises striker assembly 40 and allows it to drop. A drive assembly 46 is connected to the crank means.

The anvil assembly is conventional in that it includes an anvil plate 48 which is connected to support 26 and wires 24 as is conventional in the art. It may be appreciated that a support is shown in the instant drawing for purposes of illustration, however, the interconnection between the anvil, plate and the support 26 may be any one of well known means. A guide 50 is fixed to the anvil plate to guide striker assembly 40. Striker assembly 40 includes a sleeve 52 which mateably receives guide 50. A main weight 54 has sleeve 52 extending through it. A plurality of disk weights 56 is mounted on sleeve 52 and above weight 54 so that the weight of the striker assembly may be adjusted by addition of disk weights or removal of those weights. By adjusting the weight of the striker assembly, the magnitude of an impact force generated by the striker assembly on the anvil assembly may be adjusted in a limited range. The striker assembly includes a bolt 58 which is mounted in the upper end of sleeve 52.

Connector 42 is connected to bolt 58 by means of a loop cable portion or flexible joint 60 which has a portion which loops over bolt 58. An elongated insulator 62 is connected to cable portion 60. In this instance, the insulator is a conventional impact resistant electrical insulator which electrically separates the striker assembly from the crank assembly. The other end of insulator 62 is connected to a conventional flexible cable or flexible connector 64. The cable 64 has its other end connected to crank means 44.

Crank means 44 is connected to drive means 46 as was mentioned above. The drive means includes a conventional electric motor 66 which is drivingly connected to a conventional speed reducer 68. It is readily apparent that any other suitable source of rotating power which is known in the art may be used. The speed reducer has an output shaft 70 which is connected to the crank means. Crank means 44 includes a crank 72 which is fixed to shaft 70 to rotate with the shaft. A drive pin 74 is fixed to crank 72 and extends outwardly therefrom. An arm 76 has one end connected to crank 72 by an arm pivot pin 78 in a conventional fashion. The other end of arm 76 is connected to cable 64. The arm 76 has a plurality of mounting openings 80 which allows the cable 64 to be selectively connected to the arm to allow positioning of the cable relative to the arm. Thus, the impact force applied by the striker assembly to the anvil assembly may be adjusted by appropriate positioning of the cable in one of the mounting openings while the wires are electrically charged.

As may be seen in FIG. 2, a floor 82 is mounted on enclosure 34. Floor 82 includes a cable aperture 84 with a cable guide or flexible member guide assembly 86 mounted over the aperture 84. The cable guide assembly includes a guide plate 88 with a pair of rollers 90 rotatably mounted on the plate 88. The rollers 90 are conventional in their construction and are conventionally mounted on the plate so that cable 64 passing through the cable guide assembly is substantially aligned with the striker and guide 50 so that striker assembly 40 moves in a substantially vertical direction.

Figure 6:
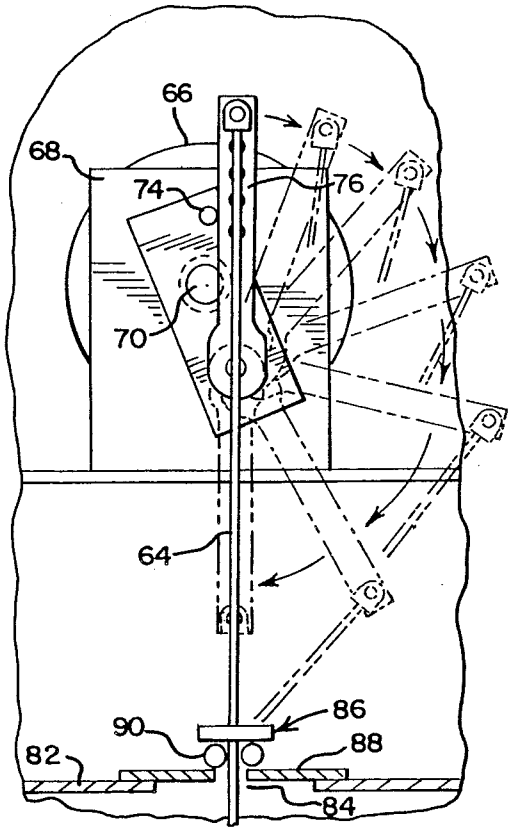
FIG. 6 is a side elevational view similar to FIG. 4 but showing the arrangement of parts wherein the striker is in a fully raised position and a portion of the crank being shown in dotted form showing the attitude of an arm when the striker falls.
Figure 5:
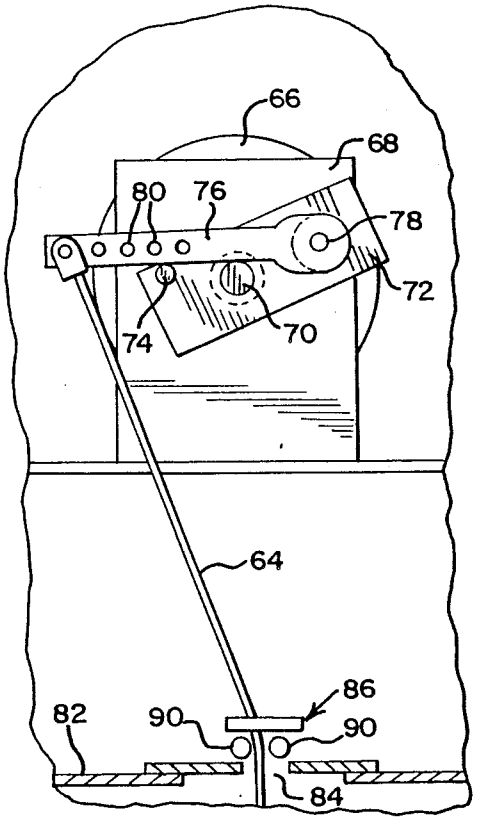
FIG. 5 is a side elevational view similar to FIG. 4 but showing the positioning of the parts when the striker is partially raised.
Figure 4:
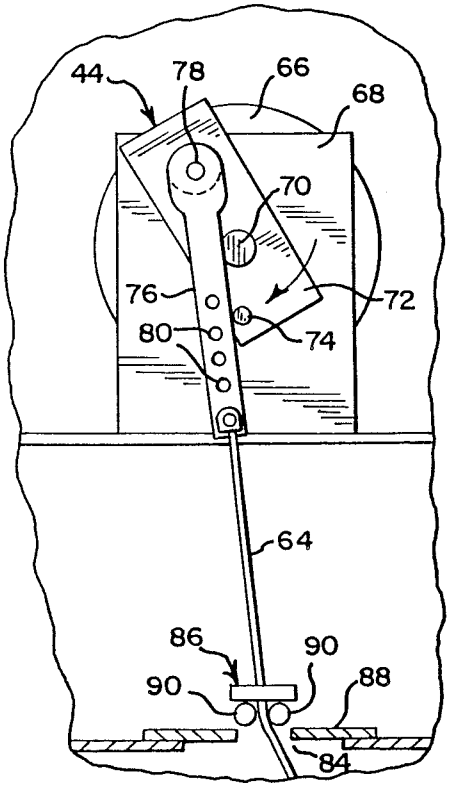
FIG. 4 is an enlarged side elevational view of a crank mechanism and drive assembly of the rapper of FIG. 2 showing the attitude of the parts when the striker is about to be raised.

Rapper 30 operates in the following fashion; in that motor 66 drives the speed reducer 68 so that shaft 70 rotates. As shaft 70 rotates, crank 72 rotates in a clockwise direction as shown in FIG. 4. Drive pin 74 engages arm 76. As the crank rotates, the end of arm 76 pivotally connected to the crank rotates in a clockwise direction and the end of the arm connected to the cable also rotates in a clockwise direction until the arm reaches the position shown in FIG. 5, at which position the cable is pulled taut thereby raising the striker assembly. Further rotation of the crank causes the end of arm 76 connected to the crank to move downward to the position shown in FIG. 6 and drive pin 74 causes the end of the arm connected to the cable to move to the vertical attitude shown in FIG. 6. Once the arm passes the vertical, the weight of the striker assembly causes the arm to pivot in a clockwise direction thereby allowing the striker assembly to drop into impact engagement with the anvil assembly and thereby hammer the anvil. The impact engagement of the striker with the anvil creates an acceleration transmital of force or a shock wave with associated vibration on the anvil and thereby vibrates the support for wires 24 and the wires through the conventional interconnection of the wires to the anvil. Thus, any material which adheres to the wires is dropped from the wires to the bottom of the precipitator where the material is collected. It may be appreciated that though the specific disclosure herein is directed to vibrating wires 24, plates or curtains as well as rigid frame electrodes may be vibrated by the instant rapper.

Another form of the present invention is shown in FIGS. 7 through 11. A rapper 100 is shown in FIGS. 7 through 11. The interconnection of the striker portion of the rapper 100 with wires or plates, being a portion of an electrostatic precipitator, is the same as that described above for rapper 30.

Figure 10:
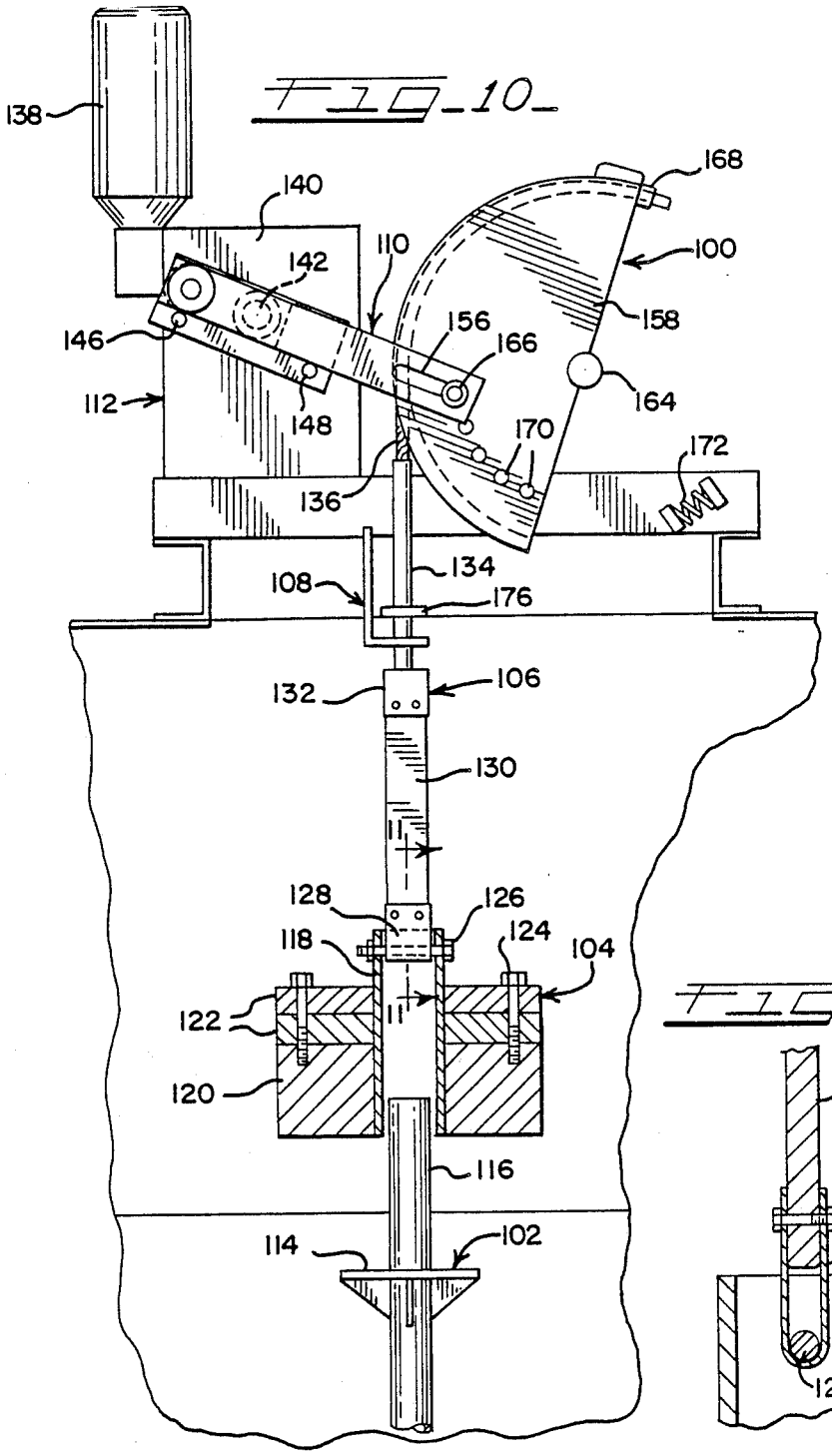
FIG. 10 is an enlarged cross sectional view similar to FIG. 2 but showing the modified form of a rapper shown in FIGS. 7, 8 and 9, showing the crank means and a connector showing the crank means at a position wherein the striker is about to commence its descent.

Referring now to FIG. 10, rapper 100 generally includes an anvil assembly 102 connected to a part of the electrostatic precipitator and specifically, in this instance, wires. A striker assembly 104 is engageable with the anvil assembly as is described in detail hereinafter. A connector 106 is secured to the striker assembly and is directed by a connector guide assembly 108. The connector is attached to crank assembly or crank means 110 which is in turn connected to drive assembly 112.

As may be seen in FIG. 10, anvil assembly 102 includes an anvil plate 114 which is connected to a part of the electrostatic precipitator in a conventiona manner to transmit vibrations to the part. A guide 116 identical to guide 50 is fixed to anvil plate 114 to guide striker assembly 104. Striker assembly 104 includes a sleeve 118 which mateably receives guide 116. A main weight 120 is fixed to and has sleeve 118 extending through it. A plurality of removable disk weights 122 is mounted on sleeve 118 and is held in place by a plurality of screws 124. The operation of weights 122 is the same as for weights 56 described above. The striker assembly includes a bolt 126 which is mounted in the upper end of sleeve 118.

Figure 11:
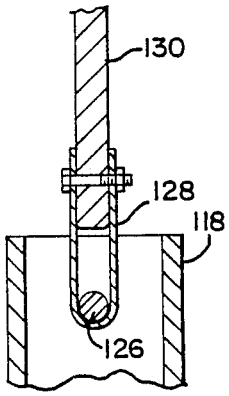
FIG. 11 is a cross sectional view taken on line 11—11 of FIG. 10 showing the interconnection between an insulator and a portion of the striker.

Connector 106 is connected to bolt 126 by a U-shaped band 128 which is connected to an elongated insulator 130 as may be seen in FIGS. 10 and 11. An upper U-shaped band 132 is connected to the other end of elongated insulator 130 and is connected to a tubular rod 134 which is an elongated rigid member. Tubular rod 134 is connected to one end of a conventional flexible cable or flexible member 136. The other end of cable 136 is connected to crank means 110.

The crank means is connected to drive means 112 as was mentioned above. The drive means includes a conventional electrical motor 138 which is drivingly connected to a conventional speed reducer 140. The speed reducer has an output or drive shaft 142 extending therefrom to which is connected crank means 110. Crank means 110 includes a crank 144 which is drivingly connected to drive shaft 142 by conventional and well known means. A drive pin 146 is fixed to the crank at one end, and an antirotation pin 148 is fixed to the other end of the crank. An arm 150 is rotatably mounted on shaft 142. A link 152 has one end pivotally connected to arm 150 through an arm pin 154. Link 152 has an elongated slot 156 at the opposite end. The slot extends along the length of the link as may be best seen in FIGS. 7 through 10.

A substantially flat plate 158 has a circular outer periphery having an arcuate track 160 on the periphery. A groove 162 is found in the track to receive cable 136. The plate is pivotally mounted on a pivot shaft 164 so that arcuate track 160 is tangential to a line extending from guide 116 so that striker assembly 104 is aligned with guide 116. A plate pin 166 is fixed to the plate and is slideably positioned in slot 156 of link 152.

Cable 136 has one end fixed to a cable stop 168 on one end of track 160 so that a portion of the cable lies in groove 162 of the arcuate track 160. Plate 158 includes a plurality of apertures 170 so that pin 166 may be appropriately positioned to vary the stroke of the crank means. A spring stop 172 is engageable with plate 158 to stop resiliently the plate at one end of rotation of the plate.

Connector guide 108 mounted in connection with the elongated rigid member 134 is aligned with guide 116 so that rigid member 134 will move in a direction substantially vertical and in alignment with guide 116 to limit movement of the striker to a vertical movement. A seal 176 is connected in engagement with rigid member 134.

Figure 7:
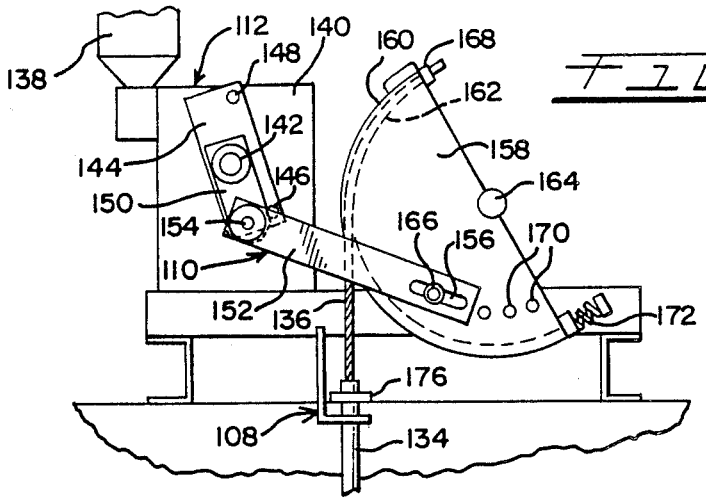
FIG. 7 is a side elevational view of a second form of the instant invention embodying a rapper mechanism showing the position of elements of a crank means when a striker is in its lowermost position just before the striker is raised.
Figure 8:
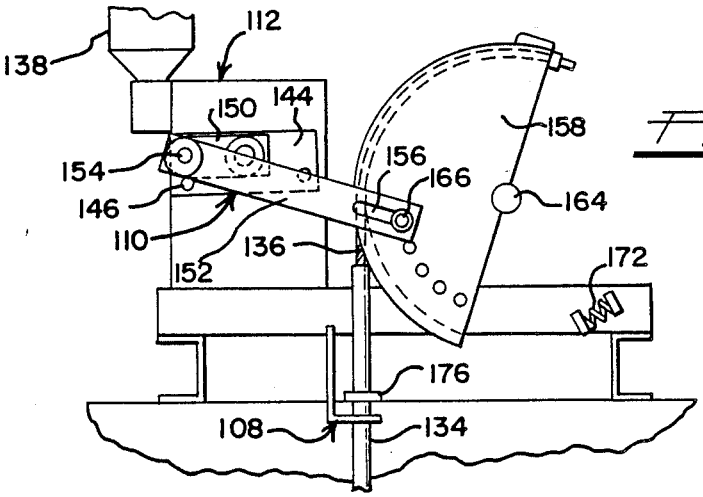
FIG. 8 is a side elevational view similar to FIG. 7 but showing the positioning of parts of the crank means of FIG. 7 when the striker is in a partially raised position.
Figure 9:
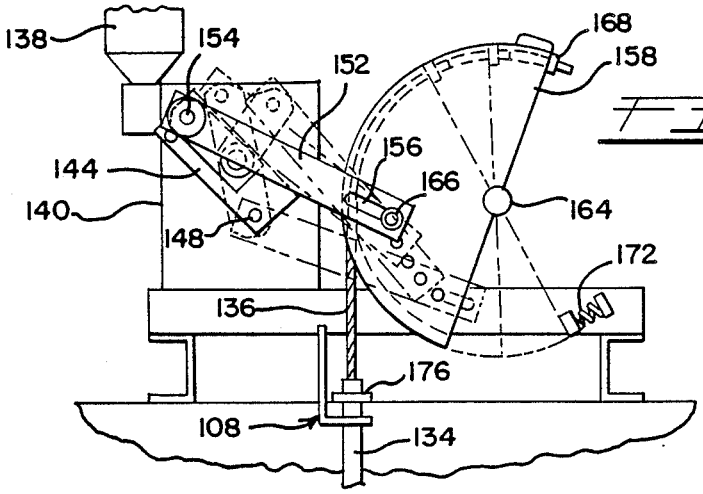
FIG. 9 is similar to FIG. 7 but showing the parts of the crank in solid form as the striker commences its descent and portions of the crank means are shown in phanthom form showing the crank means moving positions as the striker makes its descent to impact an anvil.

Rapper 100 works in the following manner in that drive means 112 rotates crank 144 until pin 146 engages arm 150 as shown in FIG. 7. The crank continues to rotate and thereby rotates plate 148 wrapping cable 136 onto the plate within groove 162 to assume the position shown in FIG. 8. Crank 144 continues to rotate until link 152 is in line with the center of shaft 142. Further rotation of crank 144 allows the weight of striker assembly 104 to pull down the plate 158 to pivot plate 158 about shaft 164 as shown in FIG. 9, thus allowing a free fall of striker assembly 104 to anvil assembly 102. Thus, striker assembly 104 provides an impact force to anvil assembly 102 to vibrate the anvil assembly in the same manner that striker assembly 40 impacts anvil assembly 38 to vibrate anvil assembly 38. The vibration from anvil assembly 102 is transmitted to the wires in this instance. However, the instant rapper may be connected to plates or a rigid frame electrode of a precipitator so that the present rapper may be utilized with any selected part of an electrostatic precipitator.

It may be appreciated that inasmuch as the insulator in both forms of the present invention is adjacent to the striker assembly, the extent of movement in a vertical direction of the striker assembly may be adjusted without interrupting the electrical charge to the wires of the electrostatic precipitator.

It may be further appreciated that by the utilization of a single electric motor to drive the instant rapper, it is possible to have one control for the rapping in an electrostatic precipitator to select rapping of various parts of an electrostatic precipitator on an individual basis. The specific embodiments of the present invention have been shown and described as rapping wires or discharge electrodes of an electrostatic precipitator. The instant rapper may be used to rap other parts of an electrostatic precipitator, such as, collector plates or electrodes or rigid frame electrodes.

Although specific embodiments of the herein disclosed invention have been described in detail above, it is readily apparent that those skilled in the art may make various modifications and changes without departing from the spirit and scope of the present invention. It is to be expressly understood that the instant invention is limited only by the appended claims.

We claim:

1. A rapper for vibrating a part of an electrostatic precipitator by an impact force comprising, in combination, an anvil connected to a part of an electrostatic precipitator for transmitting vibrations to the part, a striker for vibrating the anvil and the part by applying an impact force to the anvil, an elongated connector having one end connected to the striker, crank means for raising the striker above the anvil and allowing the striker to drop to provide an impact force to the anvil to vibrate the part, said crank means connected to the other end of the connector, said crank means for raising the striker includes an arm having one end connected to the connector, said arm being positioned above the striker, a crank pivotally connected to the other end of the arm, a stop engageable with the arm to rotate the arm with the crank and allow the arm to disengage the stop and to pivot to allow the striker to drop to hammer the anvil, and drive means connected to the crank for rotating the crank.

2. A rapper for vibrating a part of an electrostatic precipitator by an impact force comprising, in combination, an anvil connected to a part of an electrostatic precipitator for transmitting vibrations to the part, a striker for vibrating the anvil and the part by applying an impact force to the anvil, an elongated connector having one end connected to the striker, crank means for raising the striker above the anvil and allowing the striker to drop to provide an impact force to the anvil to vibrate the part, said crank means connected to the other end of the connector, said means for raising the striker includes, drive means, a crank connected to the drive means, said crank being rotated by the drive means, an arm having one end pivotally connected to the crank, a stop mounted on the crank engageable with the arm to cause the arm to rotate with the crank and then allow the arm to disengage the stop and to pivot to allow the striker to drop to engage the anvil with an impact force, and said connector including a flexible member having one end connected to the other end of the arm and the other end of the flexible member connected to the striker.

3. A rapper for vibrating a part of an electrostatic precipitator by an impact force comprising, in combination, an anvil connected to a part of an electrostatic precipitator for transmitting vibrations to the part, a striker for vibrating the anvil and the part by applying an impact force to the anvil, an elongated connector having one end connected to the striker, crank means for raising the striker above the anvil and allowing the striker to drop to provide an impact force to the anvil to vibrate the part, said crank means connected to the other end of the connector, said means for raising the striker includes, an arm having one end connected to the connector, said arm being positioned above the striker, a crank pivotally connected to the other end of the arm, a stop mounted on the crank engageable with the arm to rotate the arm with the crank and then allow the arm to disengage the stop and to pivot to allow the striker to drop and to engage the anvil with impact force, drive means connected to the crank for rotating the crank, and a guide connected to said anvil, said guide being connected to the striker for directing the movement of the striker relative to the anvil to effect a substantially straight line vertical movement of the striker relative to the anvil.

4. A rapper for vibrating a part of an electrostatic precipitator by an impact force comprising, in combination, an anvil connected to a part of an electrostatic precipitator for transmitting vibrations to the part, a striker for vibrating the anvil and the part by applying an impact force to the anvil, an elongated connector having one end connected to the striker, crank means for raising the striker above the anvil and allowing the striker to drop to provide an impact force to the anvil to vibrate the part, said crank means connected to the other end of the connector, the connector includes an elongated flexible member having one end connected to the striker, said means for raising the striker includes an arm having one end connected to the other end of the flexible member, said arm being positioned above the striker, a crank pivotally connected to the other end of the arm, a stop mounted on the crank engageable with the arm to rotate the arm with the crank and allow the arm to disengage the stop and to pivot to allow the striker to drop to hammer the anvil with an impact force, and drive means connected to the crank for rotating the crank, and a plurality of removable weight disks mounted on the striker for determining in part the magnitude of the impact force applied to the anvil.

5. A rapper for vibrating a part of an electrostatic precipitator by an impact force comprising, in combination, an anvil connected to a part of an electrostatic precipitator for transmitting vibrations to the part, a striker for vibrating the anvil and the part by applying an impact force to the anvil, an elongated connector having one end connected to the striker, crank means for raising the striker above the anvil and allowing the striker to drop to provide an impact force to the anvil to vibrate the part, said crank means connected to the other end of the connector, the connector includes a flexible cable having one end connected to the means for raising the striker, an elongated insulator having one end connected to the other end of the cable and the other end of the elongated insulator connected to the striker, said means for raising the striker including an arm having one end connected to the one end of the flexible cable, said arm being positioned above the striker, a crank pivotally connected to the other end of the arm, a stop mounted on the crank engageable with the arm to rotate the arm with the crank and allow the arm to disengage the stop and to pivot to allow the striker to drop to hammer the anvil, drive means connected to the crank for rotating the crank, and a guide connected to the anvil, said guide being connected to the striker for limiting movement of the striker relative to the anvil to effect a substantially straigh line movement of the striker relative to the anvil.

6. A rapper for vibrating a part of an electrostatic precipitator by an impact force comprising, in combination, an anvil connected to a part of an electrostatic precipitator for transmitting vibrations to the part, a striker for vibrating the anvil and the part by applying an impact force to the anvil, an elongated connector having one end connected to the striker, crank means for raising the striker above the anvil and allowing the striker to drop to provide an impact force to the anvil to vibrate the part, said crank means connected to the other end of the connector, the connector includes a flexible cable having one end connected to the means for raising the striker and the other end connected to the striker, said means for raising the striker including an arm having one end connected to the one end of the flexible cable, said arm being positioned above the striker, a crank pivotally connected to the other end of the arm, a stop mounted on the crank engageable with the arm to rotate the arm with the crank and allow the arm to disengage the stop and to pivot to allow the striker to drop to hammer the anvil, drive means connected to the crank to rotate the crank, and a cable guide engageable with the cable and being aligned with the striker, whereby said portion of the cable between the cable guide and the striker is aligned with the striker to raise the striker in a substantially straight line direction and to allow the striker to drop in a substantially straight line vertical direction for impact engageable with the anvil.

7. A rapper for vibrating a part of an electrostatic precipitator by an impact force comprising, in combination, an anvil connected to a part of an electrostatic precipitator for transmitting vibrations to the part, a striker for vibrating the anvil and the part by applying an impact force to the anvil, an elongated connector having one end connected to the striker, crank means for raising the striker above the anvil and allowing the striker to drop to provide an impact force to the anvil to vibrate the part, said crank means connected to the other end of the connector, the connector includes a flexible cable having one end connected to the means for raising the striker, an elongated insulator having one end connected to the other end of the cable and the other end of the elongated insulator connected to the striker, said means for raising the striker including an arm having one end connected to the one end of the cable, said arm being positioned above the striker, a crank pivotally connected to the other end of the arm, a stop mounted on the crank and being engageable with the arm to rotate the arm with the crank and allow the arm to disengage the stop and to pivot to allow the striker to drop to hammer the anvil, drive means connected to the crank for rotating the crank, and a plurality of removable weight disks mounted on the striker for determining in part the magnitude of the impact force applied to the anvil by the striker.

8. A rapper for vibrating a part of an electrostatic precipitator by an impact force comprising, in combination, an anvil connected to a part of an electrostatic precipitator for transmitting vibrations to the part, a striker for vibrating the anvil and the part by applying an impact force to the anvil, an elongated connector having one end connected to the striker, crank means for raising the striker above the anvil and allowing the striker to drop to provide an impact force to the anvil to vibrate the part, said crank means connected to the other end of the connector, said crank means for raising the striker includes an arcuate track secured to one end of the connector, said arcuate track receiving a portion of the connector, an elongated link having one end connected to the arcuate track, an arm having one end pivotally connected to the other end of the elongated link, a rotatable crank pivotally connected to the other end of the arm, a stop engageable with the arm to rotate the arm with the crank to a position to allow the arcuate track to move to allow the striker to drop to hammer the anvil, and drive means connected to the crank for rotating the crank.

9. A rapper for vibrating a part of an electrostatic precipitator by an impact force comprising in combination, an anvil connected to a part of an electrostatic precipitator for transmitting vibrations to the part, a striker for vibrating the anvil and the part by applying an impact force to the anvil, an elongated connector having one end connected to the striker, crank means for raising the striker above the anvil and allowing the striker to drop to provide an impact force to the anvil to vibrate the part, said crank means connected to the other end of the connector, said crank means for raising the striker includes an arcuate track secured to one end of the connector, said arcuate track being a portion of a substantially flat plate being movably mounted relative to the anvil, said arcuate track including a groove for receiving a portion of the connector, an elongated link having one end connected to the plate, an arm having one end pivotally connected to the other end of the elongated link, a rotatable crank pivotally connected to the other end of the arm, a stop engageable with the arm to rotate the arm with the crank to a position to allow the arcuate track to move to allow the striker to drop to hammer the anvil, and drive means connected to the crank for rotating the crank.

10. A rapper for vibrating a part of an electrostatic precipitator by an impact force comprising, in combination, an anvil connected to a part of an electrostatic precipitator for transmitting vibrations to the part, a striker for vibrating the anvil and the part by applying an impact force to the anvil, an elongated connector having one end connected to the striker, crank means for raising the striker above the anvil and allowing the striker to drop to provide an impact force to the anvil to vibrate the part, said crank means connected to the other end of the connector, the crank means for raising the striker includes a plate movably mounted relative to the anvil, an arcuate track formed on the outer periphery of said plate, said arcuate track containig a groove for receiving a portion of the connector, a plate pin mounted on the plate, an elongated link having a slot in one end thereof slideably receiving the plate pin, an arm having one end pivotally connected to the other end of the elongated link, a rotatable crank pivotally connected to the other end of the arm, a stop engageable with the arm to rotate the arm with the crank to a position to allow the plate to move to allow the striker to drop to hammer the anvil, and drive means connected to the crank for rotating the crank.

11. A rapper for vibrating a part of an electrostatic precipitator by an impact force comprising, in combination, an anvil connected to a part of an electrostatic precipitator for transmitting vibrations to the part, a striker for vibrating the anvil and the part by applying an impact force to the anvil, an elongated connector having one end connected to the striker, crank means for raising the striker above the anvil and allowing the striker to drop to provide an impact force to the anvil to vibrate the part, said crank means connected to the other end of the connector, the connector includes an elongated insulator having one end connected to the striker, an elongated rigid member having one end connected to the other end of the elongated insulator, a flexible cable having one end connected to the other end of the elongated rigid member; said crank means for raising the striker including an arcuate track secured to the other end of the flexible cable, said arcuate track having a groove portion for receiving a portion of the flexible cable, an elongated link having one end connected to the arcuate track, an arm having one end pivotally connected to the other end of the link, a crank pivotally connected to the other end of the arm, a stop engageable with the arm to rotate the arm with the crank to a position to allow the arcuate track to move to allow the striker to drop to hammer the anvil, drive means connected to the crank for rotating the crank, and a connector guide connectable to the elongated rigid member for limiting movement of the elongated rigid member to a substantially vertical movement.

12. A rapper for vibrating a part of an electrostatic precipitator by an impact force comprising, in combination, an anvil connected to a part of an electrostatic precipitator for transmitting vibrations to the part, a striker for vibrating the anvil and the part by applying an impact force to the anvil, an elongated connector having one end connected to the striker, crank means for raising the striker above the anvil and allowing the striker to drop to provide an impact force to the anvil to vibrate the part, said crank means connected to the other end of the connector, the connector includes an elongated insulator having one end connected to the striker, an elongated rigid member having one end connected to the other end of the elongated insulator, a flexible cable having one end connected to the other end of the elongated rigid member; said crank means for raising the striker including a substantially flat plate pivotally mounted relative to the anvil, said flat plate having an arcuate track in its outer periphery, said arcuate track having a groove portion, said flexible cable having its other end connected to the plate and having a portion of the cable positionable in a portion of the arcuate track, a plate pin mounted on said plate, an elongated link having a slotted portion adjacent to one end slideably receiving the plate pin, an arm having one end pivotally connected to the other end of the elongated link, a rotatable crank pivotally connected to the other end of the arm, a stop mounted on the crank engageable with the arm to rotate the arm with the crank to a position to allow the plate to move to allow the striker to drop to hammer the anvil, drive means connected to the crank for rotating the crank, and a connector guide connectable to the elongated rigid member for limiting motion of the elongated rigid member to a substantially vertical movement.

13. A rapper for vibrating a part of an electrostatic precipitator by an impact force comprising, in combination, an anvil connected to a part of an electrostatic precipitator for transmitting vibrations to the part, a striker engageable with the anvil to apply an impact force to the anvil for vibrating the anvil, a plurality of removable weight disks mounted on the striker for determining in part the magnitude of the impact force applied to the anvil by the striker, a guide connected to said anvil, said guide being engageable with the striker for limiting movement of the striker to effect a substantially straight line vertical movement of the striker relative to the anvil, an elongated insulator having one end connected to the striker, a flexible cable having one end connected to the other end of the elongated insulator, an arm having one end pivotally connected to the other end of the flexible cable, said arm being positioned above the striker, a crank pivotally connected to the other end of the arm, a stop mounted on the crank engageable with the arm to rotate the arm with the crank and allow the arm to disengage the stop to pivot to allow the striker to drop to hammer the anvil with an impact force, drive means connected to the crank for rotating the crank, a housing enclosing the drive means, crank and arm, and a cable guide engageable with the cable, said cable guide being aligned with the striker, whereby a portion of the cable between the cable guide and the striker is aligned with the striker to move the striker in a substantially straight line vertical motion relative to the anvil.

* * * * *